US006918862B1

(12) United States Patent
Comeau

(10) Patent No.: US 6,918,862 B1
(45) Date of Patent: Jul. 19, 2005

(54) HAND STRENGTH EXERCISER AND PROGRESS INDICATOR FOR BOTH STRONG AND WEAK HANDS

(76) Inventor: R Allan Comeau, 168 Ousamequin Pines, East Bridgewater, MA (US) 02333

( * ) Notice: Subject to any disclaimer, the term of this patent is extended or adjusted under 35 U.S.C. 154(b) by 54 days.

(21) Appl. No.: 10/626,268

(22) Filed: Jul. 24, 2003

(51) Int. Cl.[7] ..... A63B 21/008
(52) U.S. Cl. ..... 482/111; 482/49; 482/44
(58) Field of Search ..... 482/1–9, 44–50, 482/111–113

(56) References Cited

U.S. PATENT DOCUMENTS 5,336,140 A * 8/1994 LeBlond ..... 482/49
5,728,033 A * 3/1998 Rogers ..... 482/111
6,086,516 A * 7/2000 Santos ..... 482/5

* cited by examiner

*Primary Examiner*—Glenn E. Richman
(74) *Attorney, Agent, or Firm*—Robert Nathans

(57) ABSTRACT

An exercising device for strengthening hands or limbs has first and second bladders containing fluid with first and second valves that couple the bladders to a fluid pressure gage. Squeezing the first bladder by the left hand causes easy flow through the first valve to the pressure gage in a first direction, whereas the second valve presents a high impedance to flow in the same direction into the right hand bladder, so that the measured gage impulse pressure is proportional to the flow rate of fluid through the second valve indicating left hand strength. Squeezing the second bladder by the right hand produces fluid flow in the opposite direction with the right hand strength being measured in like manner. Alternate bladder squeezing creates a pleasant rhythmic exercise routine and the peak gage pressure indicates progress. The valve configuration enables strength measurement of the weak and the strong with one device.

20 Claims, 2 Drawing Sheets

HAND STRENGTH EXERCISER AND PROGRESS INDICATOR FOR BOTH STRONG AND WEAK HANDS

BACKGROUND OF THE INVENTION

The present invention relates to the field of exercising devices.

There is a need for exercising the hands in order to strengthen them over a period of time. There is also a need for indicating the progress made over the time period to encourage the exerciser to continue with the exercising routine and note his or her progress. It is desirable to provide a single device for exercising both hands in a pleasant and rhythmic fashion over an exercising interval while noting the forces produced by each hand. The exercising intervals may be performed for several weeks or more, and thus by observing and recording the measured increases of impulse pressure due to the hand squeezing process, the hopefully improving hand strengths can be individually indicated for both the right and left hands.

It is also desirable to provide a single device that can be used in the manner described for exercising and indicating the substantial hand strengths of a strong body builder and the modest hand strengths of a frail elderly person with arthritis or a similar condition, and persons having hand strengths in between these two extremes.

The aforesaid desired desired goals have not been met by the prior art retrieved during our pre-examination search. Hallerman U.S. Pat. No. 4,222,560 discloses a plurality of exercising devices for squeezing fluids to accommodate various hand strengths, each device requiring different squeeze forces. Dikeman U.S. Pat. No. 4,114,449 discloses a hand exercising device employing a single fluid filled bulb that is squeezed by one hand. The greater the squeezing pressure, the greater the displacement of a hand squeezing pressure measuring indicating member by the fluid against the compressibility action of trapped air that resists the motion of the indicating member. Thus, the fluid under compression is blocked by the movable indicator. Smith U.S. Pat. No. 4,530,496 has a similar arrangement with an optional pressure gage G in FIG. 5. Again, the fluid under compression is blocked by the movable indicator. This is in sharp contrast with the present invention, whereby fluid is forced completely through a twin pair of valves that "self adjust" to the degree of squeezing pressure. This means that the single device of the present invention can be used to continuously exercise the hands of persons having widely varying strengths over a substantial time period for exercising the hands, whereas the devices of the latter two references are not conducive to exercising the hands, and certainly not two hands over a substantial time period.

BRIEF SUMMARY OF PREFERRED EMBODIMENTS OF THE INVENTION

An exercising device for strengthening hands or limbs has first and second bladders containing fluid with first and second valves that couple the bladders to a fluid pressure gage. Squeezing the left hand bladder by the left hand causes easy flow to the right through the first valve to the pressure gage whereas the second valve presents a high impedance to flow in the same direction into the right hand bladder, so that the peak measured gage impulse pressure is proportional to the flow rate of fluid through the second valve indicating left hand strength.

Subsequent squeezing of the second bladder by the right hand produces fluid flow from right to left, to cause the fluid to easily flow through the second valve but to encounter substantial resistance through the first valve. Alternate bladder squeezing creates a pleasant rhythmic exercise routine and the peak gage pressure readings over time indicate progress in building up strength. The two specially designed valves together present a substantially constant fluid impedance from right to left and from left to right so that indicated gage pressure readings can be higher for a strong right hand for example, relative to a weaker left hand. Also, the special valve configuration enables large dynamic range pressure variations with one exercising device to enable both the weak and very strong to use the same device. A person with arthritis can transfer fluid from one bladder to the other at a very slow rate with little force being applied, to increase dexterity and strength in stiff and painful hands. In contrast, a "strong man" can produce very high mechanical impulse surges through the valves.

BRIEF DESCRIPTION OF THE DRAWINGS

Other features and advantages of the invention will become more apparent upon study of the following detailed description taken in conjunction with the drawings in which FIG. 1 discloses the presently preferred embodiment of the invention.

DETAILED DESCRIPTION OF PREFERRED EMBODIMENTS OF THE INVENTION

Figure 1:
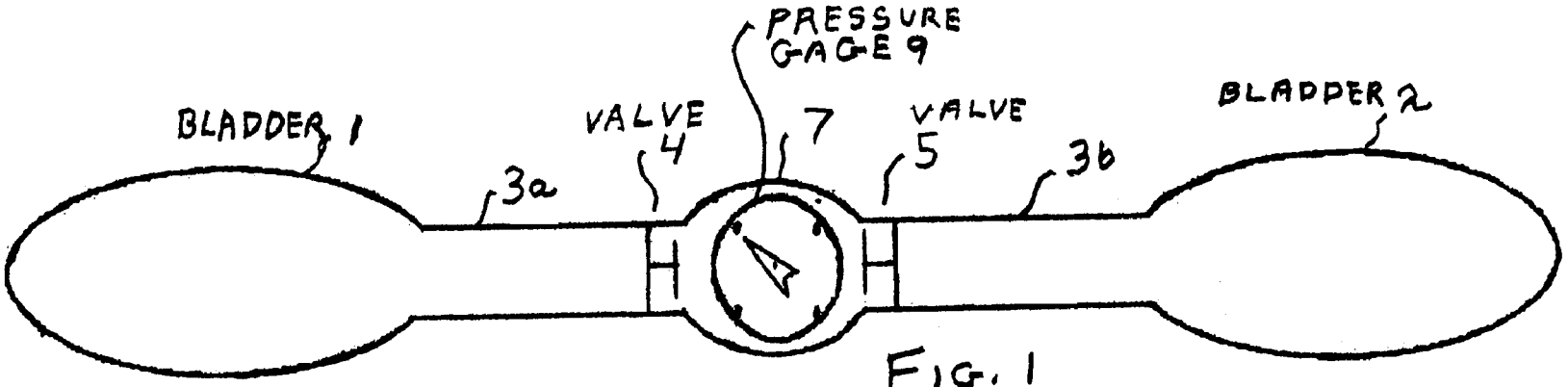

As shown in FIG. 1, first and second deflectable vessels in the form of flexible plastic bladders 1 and 2 are fluid coupled to a central pressure gage compartment 7, containing pressure gage 9, via conduits 3*a* and 3*b* and valve means 4 and 5. The entire apparatus is partially filled with fluid, preferably water. The bladders are configured to fit into the hands of the exerciser who alternately squeezes the left hand bladder 1 with his or her left hand and the right hand bladder 2 with his or her right hand. The flow 3 from squeezing the left hand bladder passes through conduit 3*a* and through two component valve 4, which presents a very low fluid impedance into the pressure gage compartment 7 at this time. However, valve means 5 at this time, presents a very high impedance to continued fluid flow from left to right into the substantially empty right hand bladder 2 via conduit 3*b*. This high impedance state of the right hand valve means 5 causes the peak impulse pressure to rapidly rise and be indicated by pressure gage 9 in compartment 7. Fluid flow from left to right is then terminated as the right hand bladder 2 receives most of the fluid formerly stored in the left hand bladder 1.

Now the right hand of the exerciser squeezes right hand bladder 2 to reverse the aforesaid procedure. Fluid flows from right to left through conduit 3*b* and the second two part valve means 5, which is now forced into a low impedance condition and valve means 4 is now forced into a high impedance condition causing the aforesaid peak pressure impulse to be again indicated by the pressure gage.

Figure 2:
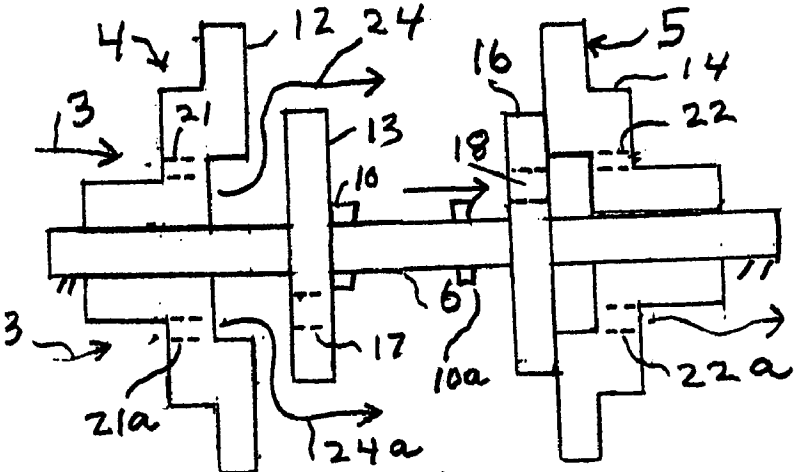
FIG. 2 discloses the two part valves 4 and 5 of FIG. 1.
Figure 3:
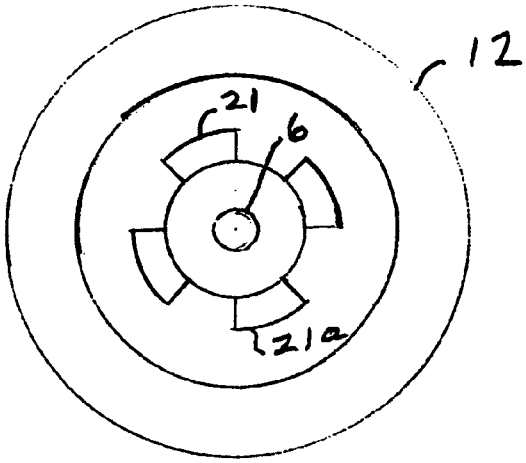
FIGS. 3–6 disclose the component valve disk members of valves 4 and 5 positioned from left to right as shown in FIG. 2.
Figure 4:
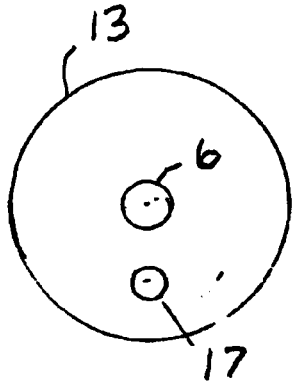

The first two part valve means 4 has a first circular valve member 12 affixed to mechanical ground by, for example support rod 6 and has a large passageway formed therein by a number of arcuate passageways 21 and 21*a*, shown in FIGS. 2 and 3. The rod also supports a second valve member of FIG. 4 in the form of a circular disk 13 having a small orifice 17 therein, that is movable and can slide over support member 6.

Figure 5:
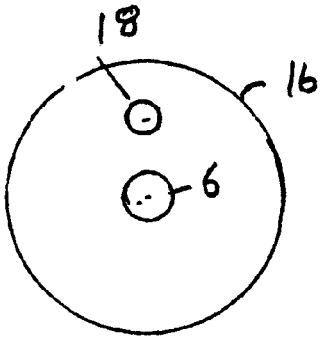
Figure 6:
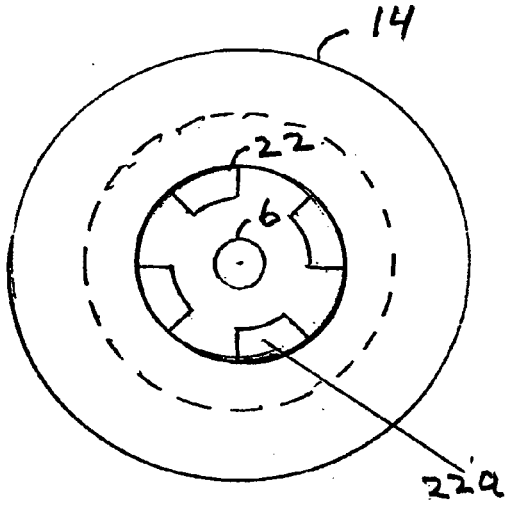

In like manner, the second right hand valve means 5 has a circular valve member 14 affixed to mechanical ground by, for example a support rod 6 and has a large passageway formed therein by a number of curved passageways 22 and 22*a,* shown in FIGS. 2 and 6. The rod also supports a second valve member of FIG. 5 in the form of a circular disk 16 having a small orifice 18 therein, that is movable and can slide over support member 6. The force of fluid from left to right as indicated by arrow 24 in FIG. 2 sees a low impedance to the flow as disk 13 is pushed to the right and fluid flows through the large passageway formed by 21 and around the valve member 13 as indicated. At this time, the fluid flow pushes valve disk 16 to the right against valve member 14 so that fluid is forced to flow through tiny orifice 18 that presents the aforesaid high impedance which produces the needed fluid resistance for exercising the left hand and the peak fluid impulse is shown by gage 9. Most of the fluid is thus transferred from bladder 1 into bladder 2 and the stage is now set for the reverse fluid flow to exercise the right hand. The right hand squeeze action against the bladder forces movable disk 16 to the left and the right hand two part valve 5 now presents a low resistance to the fluid; the movable disk 13 is shifted to the left against valve member 12 and thus the left hand two part valve 4 now presents a high impedance because the fluid must pass through the tiny orifice 17, as member 13 is forced against the inner surface of valve member 12. In other words, each two part valve member presents alternate high and low impedances to the flow of fluid depending upon the direction of fluid flow. Stops 10 and 10*a* limit the motion of movable valve members 13 and 16. Members 12 and 14 could be movable while members 13 and 16 could be stationary so long as there is relative movement between the members.

Thus, squeezing the first bladder 1 by the left hand causes easy flow through the first valve 4 to the pressure gage 9 in a first direction from left to right, whereas the second valve 5 presents a high fluid flow resistance at this time into the right hand bladder, so that the measured gage impulse pressure is proportional to the flow rate of fluid through the second valve, indicating left hand strength. Squeezing the second bladder by the right hand produces fluid flow in the opposite direction with the right hand strength being measured in like manner. Accordingly, the described valve configuration enables production of strength measurement data sets of the weak and the strong with one device. It will be apparent, owing to the described symmetrical valve configuration, that fluid impedance will be the substantially the same regardless of the flow from right to left and from left to right. Hence the two sets of pressure gage measurements can indicate the different measured strengths of the left and right hands, the latter often being stronger than the left hand.

Alternate bladder squeezing creates a pleasant rhythmic exercise routine and the peak gage pressure indicates progress. As the hands are strengthened, the increased squeeze force causes the flow rate or impulse through the device to increase, increasing the sharp peak impulse measured by the pressure gage.

The measured hand strength range is beneficially large facilitating use by both the strong and weak. During experimental use of the above described prototype, the maximum force exerted by the inventor's nine year old son registered four psi on the gage; his eighty year old mother registered five psi, and on a good day the inventor was able to register ten psi. If one was trying to do ten to fourteen repetitions per exercise set the gage readings would be smaller and for use as therapy for weak hands the peak pressures could be as low as one to two psi for twenty repetitions. Regardless, progress in strengthening the hands would be indicated by increased pressure readings. The gage indications are thus proportional to mechanical impulse, namely the product of the average force acting upon a body and the time during which it acts.

Since variations on the foregoing may readily occur to the worker in the art, the scope of the invention is to be limited solely to the terms of the following claims and equivalents thereof. For example, valves having rotational flaps with two torsional springs of differing stiffness coefficients could conceivably be employed but the disclosed sturdy valve arrangements are greatly preferred. While the invention is primarily concerned with exercising the hands, other body portions such as leg portions may benefit.

I claim:

1. An exercising device for strengthening body members comprising:

(a) first and second deflectable vessels for containing fluid therein;

(b) first valve means, fluid coupled to said first deflectable vessel, having a low fluid impedance for fluid flow out of said first deflectable vessel in a first direction and a high fluid impedance for fluid flow in a second direction opposite said first direction;

(c) second valve means, fluid coupled to said second deflectable vessel, having a low fluid impedance for fluid flow out of said second deflectable vessel in said second direction opposite said first direction, and a high fluid impedance for fluid flow in said first direction; and (d) fluid pressure measuring means, fluid coupled between said first and second valve means, for measuring fluid impulse pressure produced by alternate deflection of said first and second deflectable vessels in turn produced by motion of said body members.

2. The exercising device of claim 1 wherein said first and second deflectable vessels are flexible bladder members configured to fit into an exerciser's hands.

3. The exercising device of claim 1 wherein each valve means includes a first and second valve member, movable with respect to each other, and wherein said first valve member has a small fluid conducting passageway for severely restricting fluid flow therethrough, and wherein said second valve member has a fluid conducting passageway that is large relative to said small fluid conducting passageway for facilitating relatively unrestricted fluid flow.

4. The exercising device of claim 2 wherein each valve means includes a first and second valve member, movable with respect to each other, and wherein said first valve member has a small fluid conducting passageway for severely restricting fluid flow therethrough, and wherein said second valve member has a fluid conducting passageway that is large relative to said small fluid conducting passageway for facilitating relatively unrestricted fluid flow.

5. An exercising device for strengthening body members comprising:

(a) first and second deflectable vessels for containing fluid therein;

(b) first valve means, fluid coupled to said first deflectable vessel, having a low fluid impedance for fluid flow out of said first deflectable vessel in a first direction and a high fluid impedance for fluid flow in a second direction opposite said first direction;

(c) second valve means, fluid coupled to said second deflectable vessel, having a low fluid impedance for fluid flow out of said second deflectable vessel in said second direction opposite said first direction, and a high fluid impedance for fluid flow in said first direction; and (d) a fluid pressure measuring means, fluid coupled between said first and second valve means, for measuring fluid impulse pressure produced by alternate deflection of said first and second deflectable vessels in turn produced by motion of said body members; and (e) wherein said first and second valve means are configured so as to together present a substantially constant fluid impedance to the flow of fluid through both valve means in said first and said second directions regardless of variations in fluid impulse pressures created by deflection of said deflectable vessels by various persons.

6. The exercising device of claim 5 wherein said first and second deflectable vessels are flexible bladder members configured to fit into an exerciser's hands.

7. The exercising device of claim 5 wherein each valve means includes a first and second valve member, movable with respect to each other, and wherein said first valve member has a small fluid conducting passageway for severely restricting fluid flow therethrough, and wherein said second valve member has a fluid conducting passageway that is large relative to said small fluid conducting passageway for facilitating relatively unrestricted fluid flow.

8. The exercising device of claim 6 wherein each valve means includes a first and second valve member, movable with respect to each other, and wherein said first valve member has a small fluid conducting passageway for severely restricting fluid flow therethrough, and wherein said second valve member has a fluid conducting passageway that is large relative to said small fluid conducting passageway for facilitating relatively unrestricted fluid flow.

9. An exercising device for strengthening body members comprising:

(a) first and second deflectable vessels for containing fluid therein;

(b) first valve means, fluid coupled to said first deflectable vessel, having a low fluid impedance for fluid flow out of said first deflectable vessel in a first direction and a high fluid impedance for fluid flow in a second direction opposite said first direction;

(c) second valve means, fluid coupled to said second deflectable vessel, having a low fluid impedance for fluid flow out of said second deflectable vessel in said second direction opposite said first direction, and a high fluid impedance for fluid flow in said first direction; and (d) fluid coupling means for fluid coupling said first and second valve means together in tandem relationship with each other for enabling simultaneous fluid flow through the first and second valve means.

10. The exercising device of claim 9 wherein said first and second deflectable vessels are flexible bladder members configured to fit into an exerciser's hands.

11. The exercising device of claim 9 wherein each valve means includes a first and second valve member, movable with respect to each other, and wherein said first valve member has a small fluid conducting passageway for severely restricting fluid flow therethrough, and wherein said second valve member has a fluid conducting passageway that is large relative to said small fluid conducting passageway for facilitating relatively unrestricted fluid flow.

12. The exercising device of claim 10 wherein each valve means includes a first and second valve member, movable with respect to each other, and wherein said first valve member has a small fluid conducting passageway for severely restricting fluid flow therethrough, and wherein said second valve member has a fluid conducting passageway that is large relative to said small fluid conducting passageway for facilitating relatively unrestricted fluid flow.

13. The exercising device of claim 9 wherein said first and second valve means are configured so as to together present a substantially constant fluid impedance to the flow of fluid through both valve means in said first and said second directions regardless of variations in fluid impulse pressures created by deflection of said deflectable vessels by various persons.

14. The exercising device of claim 10 wherein said first and second valve means are configured so as to together present a substantially constant fluid impedance to the flow of fluid through both valve means in said first and said second directions regardless of variations in fluid impulse pressures created by deflection of said deflectable vessels by various persons.

15. The exercising device of claim 11 wherein said first and second valve means are configured so as to together present a substantially constant fluid impedance to the flow of fluid through both valve means in said first and said second directions regardless of variations in fluid impulse pressures created by deflection of said deflectable vessels by various persons.

16. The exercising device of claim 12 wherein said first and second valve means are configured so as to together present a substantially constant fluid impedance to the flow of fluid through both valve means in said first and said second directions regardless of variations in fluid impulse pressures created by deflection of said deflectable vessels by various persons.

17. A method of exercising a pair of first and second body members comprising the steps of:

(a) providing an exercising device having first and second flexible bladders for creating fluid pressure impulses produced by squeezing fluid contained therein by said first and second body members respectively, together with fluid impedance means fluid coupled between said first and second flexible bladders for presenting a substantially constant fluid impedance to the flow of fluid therethrough in first and said second directions opposite to each other, regardless of variations in fluid impulse pressures created by deflection of said flexible bladders by persons having widely varying strengths; and (b) alternately squeezing said first and second flexible bladders forcing fluid through said fluid impedance means in first and second directions respectively, over an exercising period for strengthening said first and second body members.

18. The method of claim 17 further including the step of measuring fluid impulse pressure produced by deflection of said first and second flexible bladders, indicating progressive strengthening of said body members over substantial time periods.

19. The method of claim 17 wherein step (b) is carried out by alternately squeezing said first and second flexible bladders by a person's hands.

20. The method of claim 18 wherein step (b) is carried out by alternately squeezing said first and second flexible bladders by a person's hands.

* * * * *